US008684688B2

(12) United States Patent
Wu et al.

(10) Patent No.: US 8,684,688 B2
(45) Date of Patent: Apr. 1, 2014

(54) SERIES-CONNECTED FAN FRAME MODULE

(75) Inventors: Zhe-Hao Wu, Kaohsiung (TW); Chih-Ming Chang, Kaohsiung (TW)

(73) Assignee: Sunonwealth Electric Machine Industry Co., Ltd, Kaohsiung (TW)

( * ) Notice: Subject to any disclaimer, the term of this patent is extended or adjusted under 35 U.S.C. 154(b) by 451 days.

(21) Appl. No.: 13/005,605

(22) Filed: Jan. 13, 2011

(65) Prior Publication Data

US 2012/0121406 A1 May 17, 2012

(30) Foreign Application Priority Data

Nov. 16, 2010 (TW) ..... 99139387 A

(51) Int. Cl.
*F01D 25/28* (2006.01)

(52) U.S. Cl.
USPC ..... 415/213.1; 415/214.1; 416/124

(58) Field of Classification Search
USPC ..... 415/213.1, 214.1; 416/120, 124, 125, 416/128, 198 R
See application file for complete search history.

(56) References Cited

U.S. PATENT DOCUMENTS 6,375,440 B2 * 4/2002 Kosugi ..... 417/423.14
6,827,549 B1 12/2004 Horng et al.
7,156,611 B2 * 1/2007 Oosawa et al. ..... 415/68
7,585,150 B2 9/2009 Hsu et al.
2008/0260530 A1 * 10/2008 Nishizawa et al. ..... 415/220
2009/0022587 A1 * 1/2009 Yoshida et al. ..... 415/213.1
2009/0214337 A1 * 8/2009 Yoshida et al. ..... 415/214.1

FOREIGN PATENT DOCUMENTS

TW M278954 Y 10/2005
TW M285198 Y 1/2006
TW M285199 Y 1/2006
TW M332744 5/2008
TW M333037 5/2008
TW M343076 10/2008

* cited by examiner

*Primary Examiner* — Edward Look
*Assistant Examiner* — Lester W Forsythe, Jr.
(74) *Attorney, Agent, or Firm* — Alan Kamrath; Kamrath IP Lawfirm, P.A.

(57) ABSTRACT

A series-connected fan frame module includes a plurality of frames, an engaging assembly and an anti-rotation assembly. The frames are arranged in series. The engaging assembly is arranged on each of the frames to couple the frames in series. The anti-rotation assembly is arranged on each of the frames and includes at least one position-fixing member and at least one blocking member arranged on portions of adjacent two of the frames where the adjacent two of the frames are coupled together. The at least one position-fixing member is engaged with the at least one blocking member to prevent relative radial rotation between the adjacent two of the frames.

10 Claims, 8 Drawing Sheets

SERIES-CONNECTED FAN FRAME MODULE

BACKGROUND OF THE INVENTION

1. Field of the Invention

The present invention generally relates to a series-connected fan frame module and, more particularly, to a series-connected frame fan module that has a plurality of frames connected in series, in which axial disengagement and relative radial rotation of the frames are prevented.

2. Description of the Related Art

Referring to FIG. 1, Taiwanese Patent Number 569663 discloses a conventional series-connected fan frame module, which includes a first fan unit 81, a second fan unit 82 and two coupling members 83 and 84. The coupling members 83 and 84 couple the first fan unit 81 and the second fan unit 82 together in series. One of the coupling members 83 and 84 is in the form of engaging grooves while the other one is in the form of engaging tongues.

In the conventional series-connected fan frame module 8, the first fan unit 81 and the second fan unit 82 are mainly connected in series via the coupling members 83 and 84 (namely, the engaging grooves and engaging tongues). In addition, based on a central direction that extends through centers of the two impellers 85 installed in the first fan unit 81 and the second fan unit 82, the coupling members 83 and 84 not only can prevent the first fan unit 81 and the second fan unit 82 from axially disengaging from each other along the central direction, but also prevent the first fan unit 81 and the second fan unit 82 from relatively rotating with each other in a radial direction perpendicular to the central direction. However, since both the axial disengagement and relative radial rotation between the first fan unit 81 and the second fan unit 82 are prevented by the coupling members 83 and 84 only, the coupling members 84 tend to snap easily under vibrating pressure during rotation of the first fan unit 81 and the second fan unit 82. Furthermore, since the coupling members 83 and 84 are primarily used to prevent the axial disengagement between the first fan unit 81 and the second fan unit 82, the coupling members 83 and 84 cannot effectively prevent the relative radial rotation between the first fan unit 81 and the second fan unit 82 if a gap still exists between the coupling members 83 and 84 after they are engaged together. As a result, the relative radial rotation between the first fan unit 81 and the second fan unit 82 easily results, leading to a poor engaging effect between the first fan unit 81 and the second fan unit 82.

Referring to FIG. 2, a plurality of screws is used to replace the engaging grooves and tongues described above. In this case, the first fan unit 81 and the second fan unit 82 are coupled together in series by way of screws 86, which also prevents the axial disengagement and relative radial rotation between the first fan unit 81 and the second fan unit 82. However, in contrast to engaging the first fan unit 81 and the second fan unit 82 together, screwing the first fan unit 81 and the second fan unit 82 together causes more inconvenience during assembly.

Moreover, Taiwanese Patent Number M332744 discloses another type of conventional series-connected fan frame module. Referring to FIG. 3, the conventional series-connected fan frame module 9 includes a first housing 91 and a second housing 92. The first housing 91 includes a plurality of engaging members 911, and the second housing 92 includes a plurality of engaging holes 921. The engaging members 911 are inserted into the engaging holes 921 when the first housing 91 and the second housing 92 are coupled with each other in series. Based on this, the axial disengagement and relative radial rotation between the first housing 91 and the second housing 92 can also be prevented.

However, when the engaging members 911 are being engaged into the engaging holes 921, the engaging members 911 tend to easily snap off. More specifically, since the axial disengagement and relative radial rotation between the first housing 91 and the second housing 92 are prevented via the engaging members 911 only, the engaging members 911 tend to snap easily under vibrating pressure during rotation of the first housing 91 and the second housing 92.

Furthermore, similar problems arise for other conventional series-connected fan frame modules disclosed in the Taiwanese Patents numbered I285707, M278954, M285198, M285199, M333037 and M343076, so they are not described herein again for brevity.

In conclusion, even though the axial disengagement and relative radial rotation between a plurality of series-connected frames are provided in the various conventional series-connected fan frame modules described above, a weaker structural intensity or an inconvenient assembly of the conventional series-connected fan frame modules is still present.

SUMMARY OF THE INVENTION

It is therefore the primary objective of this invention to provide a series-connected fan frame module having a plurality of frames, in which both the axial disengagement and relative radial rotation between the frames are prevented via an engaging assembly. Furthermore, the series-connected fan frame module further utilizes an anti-rotation assembly to further prevent the relative radial rotation between the frames for improved structural intensity.

It is another objective of this invention to provide a series-connected fan frame module having a plurality of frames, in which quick assembly of the series-connected fan frame module can be provided to prevent the axial disengagement and relative radial rotation between the frames.

The invention discloses a series-connected fan frame module including a plurality of frames, an engaging assembly and an anti-rotation assembly. The frames are arranged in series. The engaging assembly is arranged on each of the frames to couple the frames in series. The anti-rotation assembly is arranged on each of the frames and comprises at least one position-fixing member and at least one blocking member arranged on portions of adjacent two of the frames where the adjacent two of the frames are coupled together. The at least one position-fixing member is engaged with the at least one blocking member to prevent relative radial rotation between the adjacent two of the frames.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
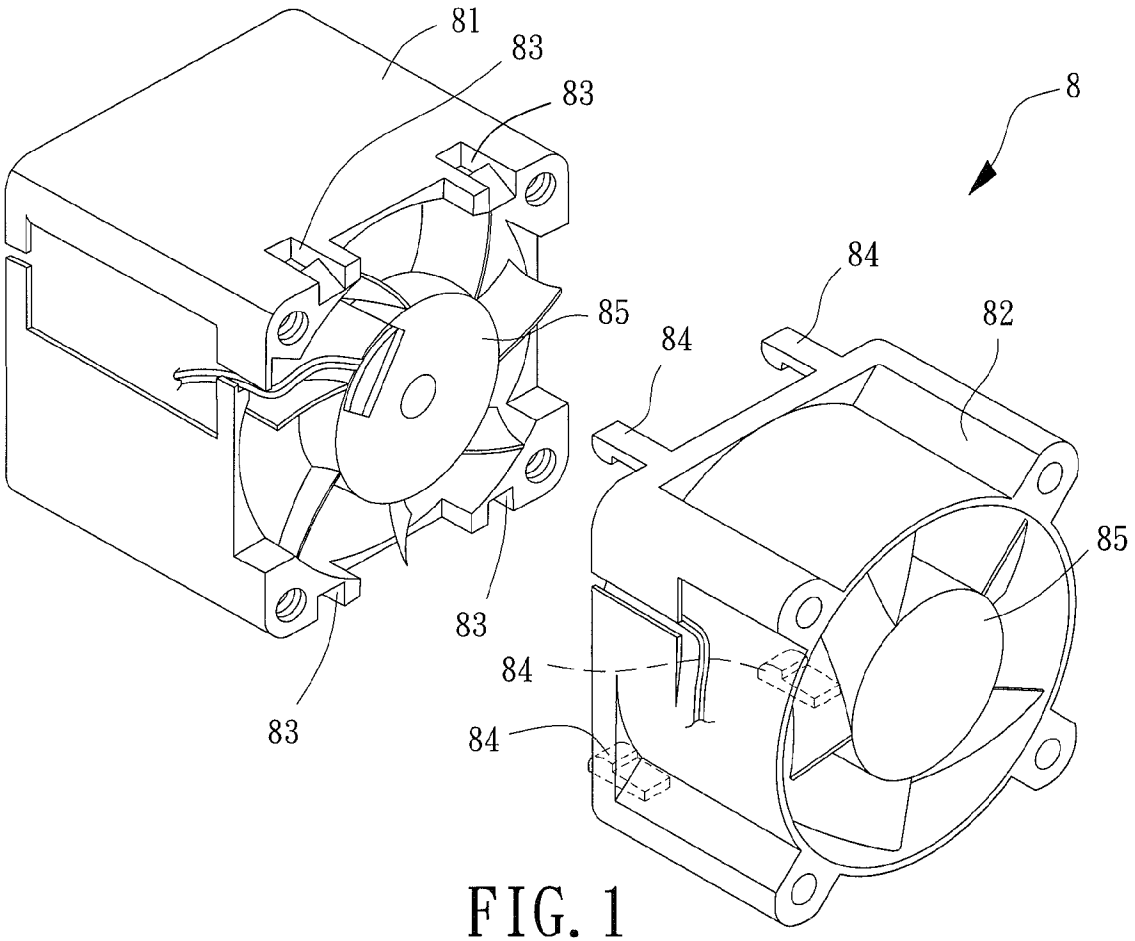
FIG. 1 PRIOR ART
FIG. 1 shows an exploded view of a conventional series-connected fan frame module.
Figure 2:
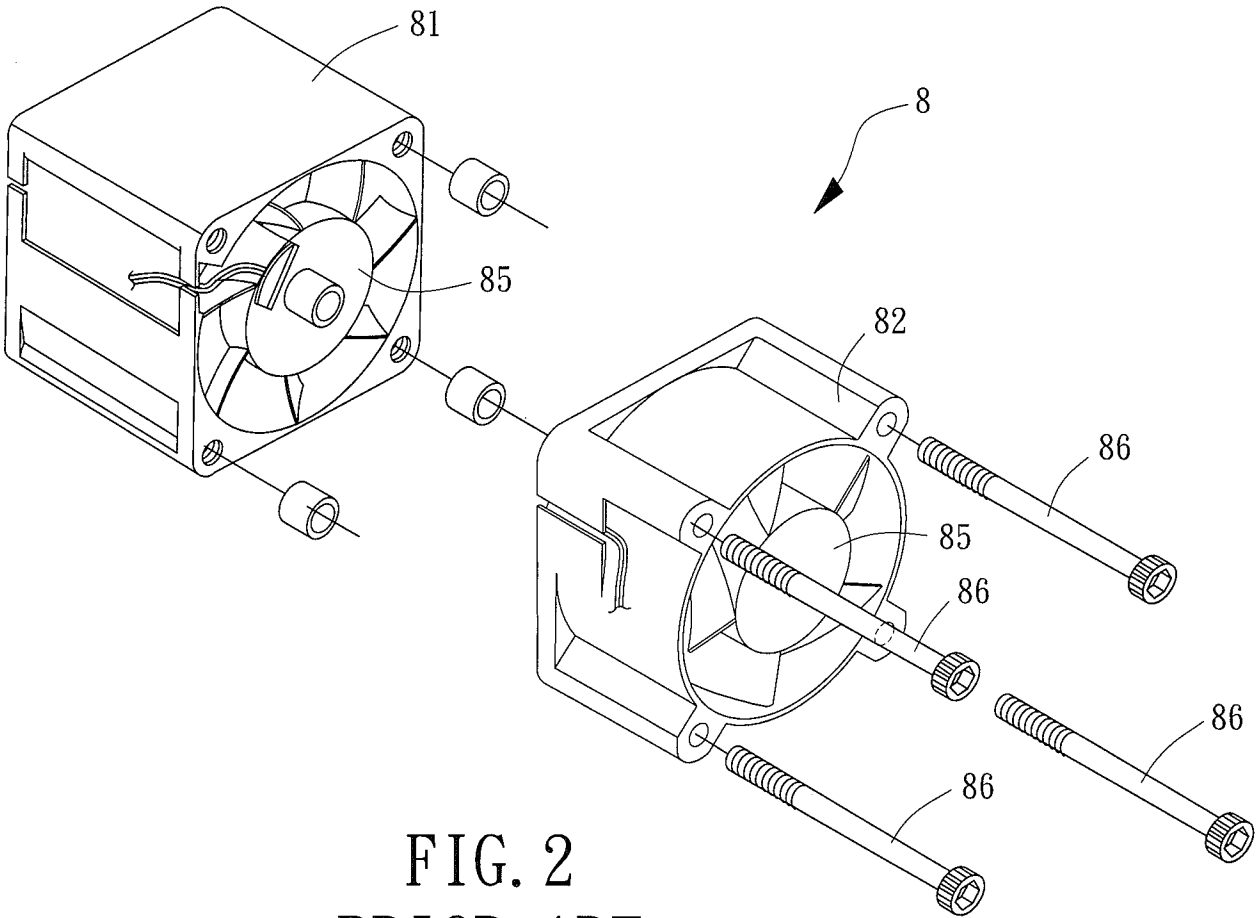
FIG. 2 PRIOR ART
FIG. 2 shows an exploded view of another conventional series-connected fan frame module.
Figure 3:
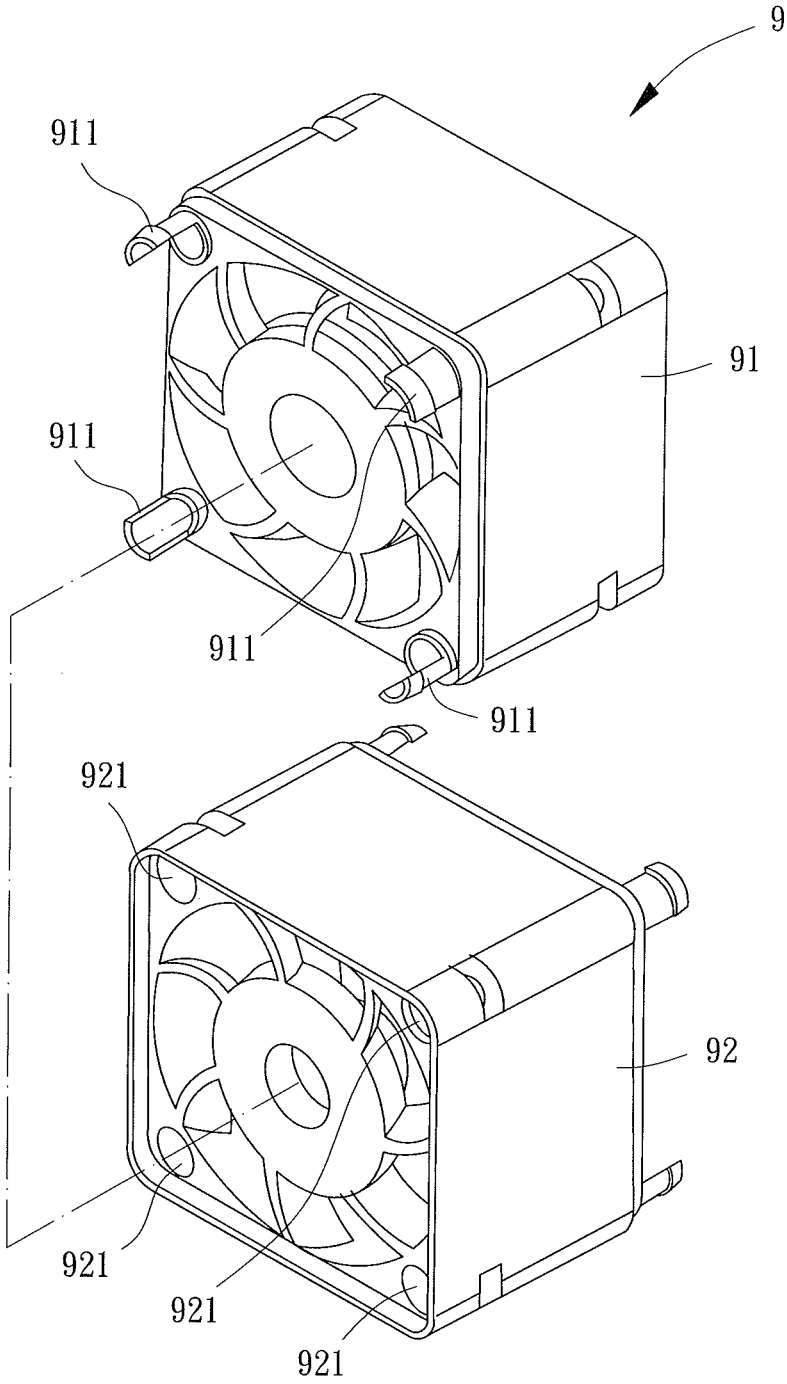
FIG. 3 PRIOR ART
FIG. 3 shows an exploded view of yet another conventional series-connected fan frame module.

In the various figures of the drawings, the same numerals designate the same or similar parts. Furthermore, when the terms "first", "second", "third", "fourth", "inner", "outer", "top", "bottom" and similar terms are used hereinafter, it should be understood that these terms refer only to the structure shown in the drawings as it would appear to a person viewing the drawings and are utilized only to facilitate describing the invention.

DETAILED DESCRIPTION OF THE INVENTION

Figure 4:
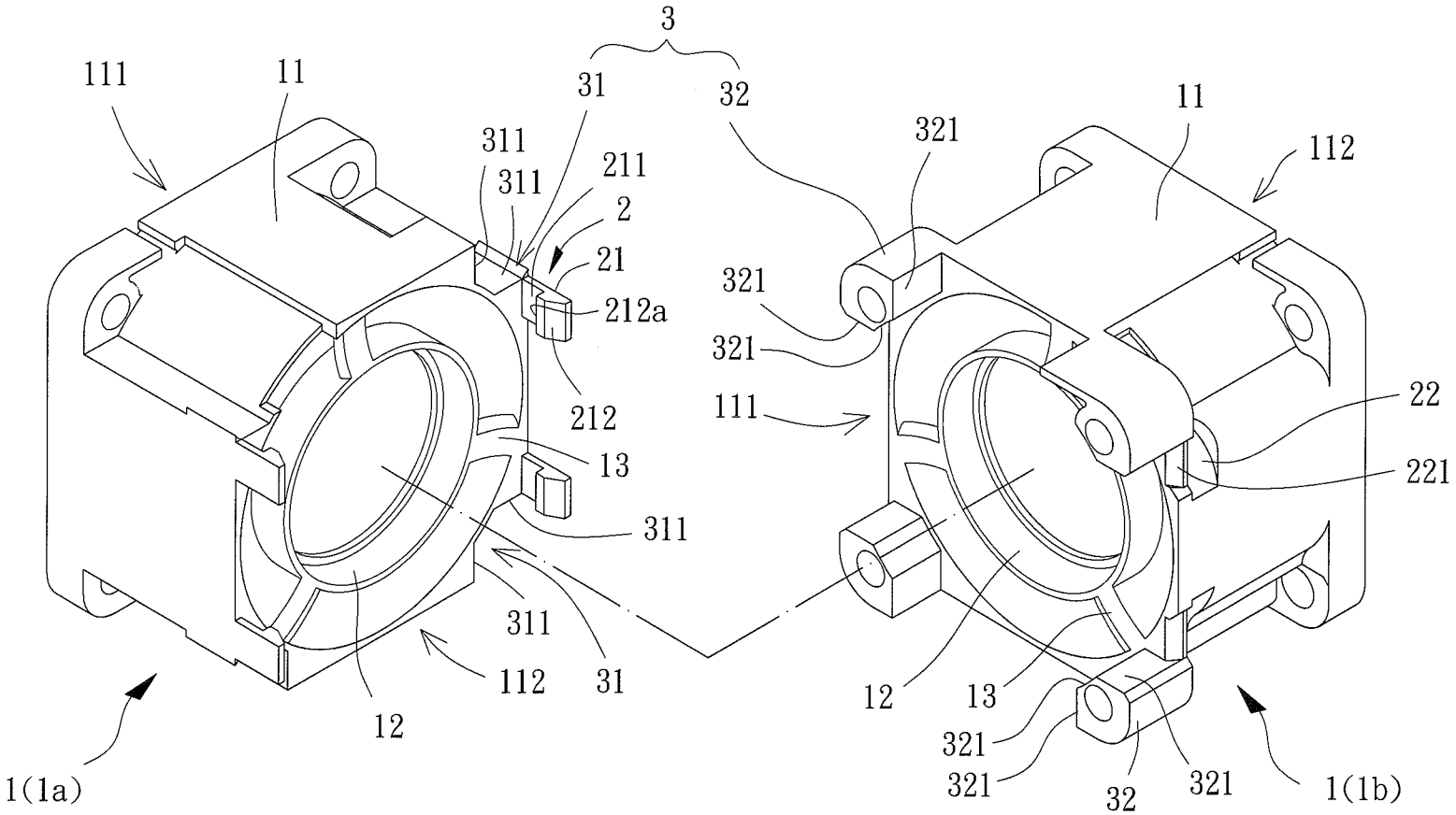
FIG. 4 shows an exploded view of a series-connected fan frame module according to a preferred embodiment of the invention.

Referring to FIG. 4, a series-connected fan frame module including two frames 1, an engaging assembly 2 and an anti-rotation assembly 3 is disclosed according to a preferred embodiment of the invention. The frames 1 are coupled together in series. The engaging assembly 2 is arranged on both frames 1 to prevent the axial disengagement and relative radial rotation between the frames 1. The anti-rotation assembly 3 is also arranged on both frames 1 to further prevent the relative radial rotation between the frames 1.

The frames 1 may be of an axial-flow or centrifugal type, and each has a frame body 11. The frame body 11 is hollow and includes an air inlet 111 and an air outlet 112. The frame body 11 further includes a base 12 disposed therein for coupling components such as a motor or the like (the details are described later).

In the embodiment, the frames 1 are of the axial-flow type. The air inlet 111 and the air outlet 112 are axially aligned. The base 12 is disposed at the air inlet 111 or the air outlet 112 via a plurality of connection members 13 (such as ribs or stationary blades). The two frames 1 can be defined as a first frame 1*a* and a second frame 1*b*, with both bases 12 of the first frame 1*a* and the second frame 1*b* being in the form of a positioning ring. At this point, the base 12 (positioning ring) of the first frame 1*a* may abut against the base 12 (positioning ring) of the second frame 1*b* to improve the coupling effect between the first frame 1*a* and the second frame 1*b*.

The engaging assembly 2 is arranged between the two frames 1 and includes at least one first engaging member 21 and at least one second engaging member 22. The at least one first engaging member 21 and at least one second engaging member 22 are formed on portions of the frames 1 where the frames 1 are coupled with each other. The at least one first engaging member 21 and at least one second engaging member 22 may be formed on or assembled to the two frames 1, respectively. In addition, the at least one first engaging member 21 and at least one second engaging member 22 are of structures which allow them to be engaged with and detached from each other. Based on this, the engaging assembly 2 may prevent the axial disengagement and relative radial rotation between the frames 1 when the frames 1 are connected in series.

Figure 5:
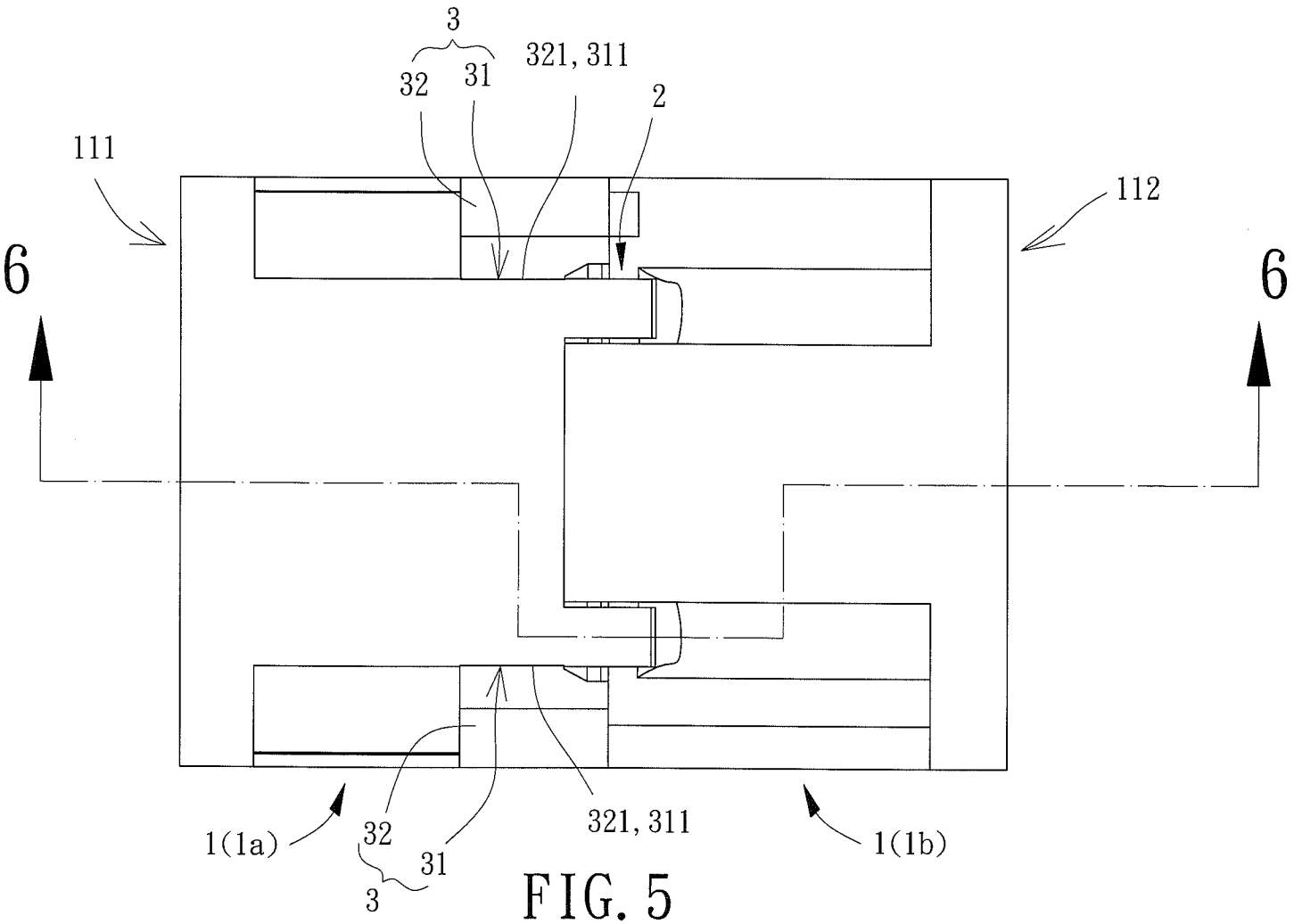
FIG. 5 shows a view of an assembly plane of the conventional series-connected fan frame module according to the preferred embodiment of the invention.
Figure 6:
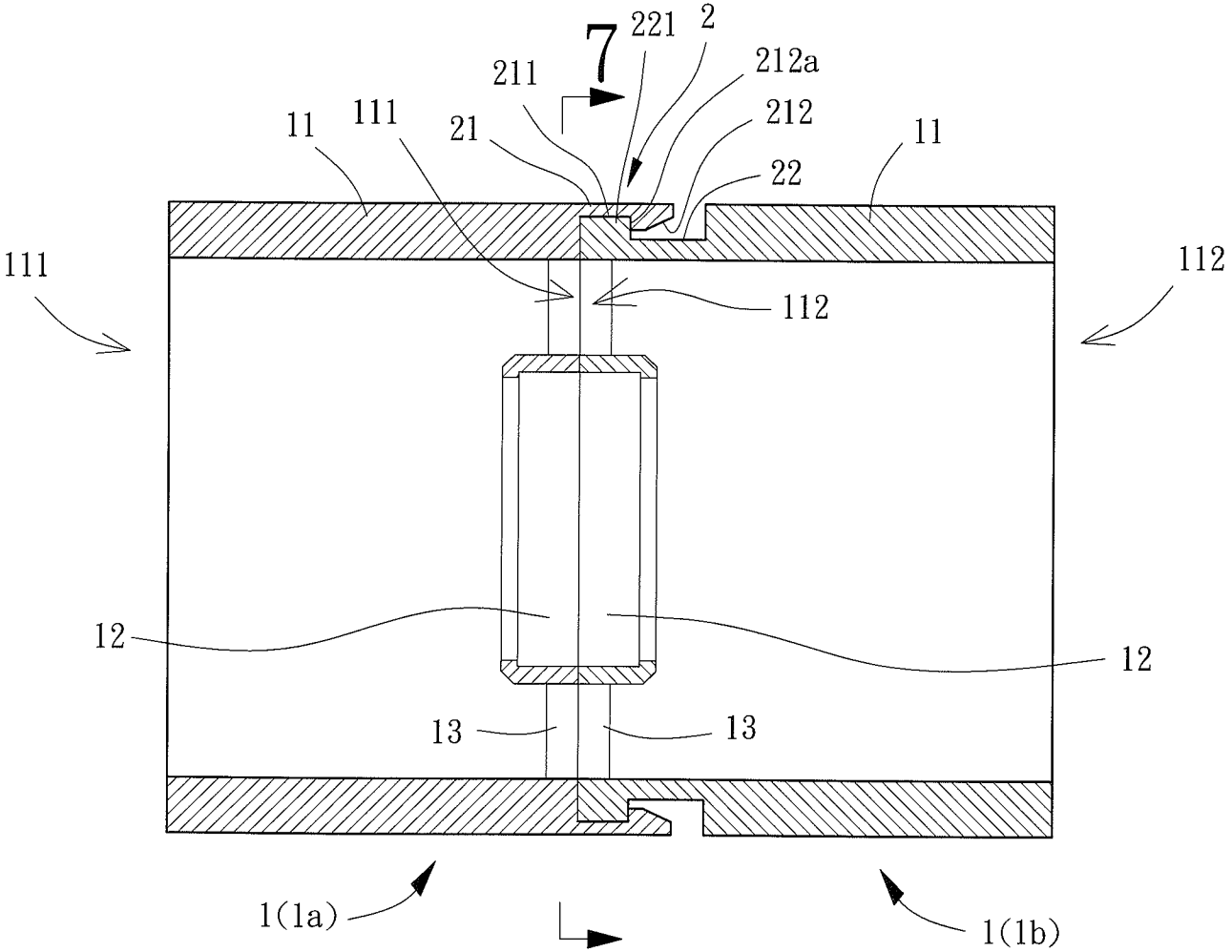
FIG. 6 shows a side cross-sectional view of the series-connected fan frame module observed at line 6-6 in FIG. 5, according to the preferred embodiment of the invention.

In the embodiment, the at least one first engaging member 21 is located on the first frame 1*a* and the at least one second engaging member 22 is located on the second frame 1*b*. Specifically, each first engaging member 21 is in the form of an engaging panel located on an outer edge of a face of the first frame 1*a* that faces the second frame 1*b*, with the first engaging member 21 (engaging panel) having one end coupling with the first frame 1*a* and the other end axially extending towards the second frame 1*b*. Furthermore, each first engaging member 21 includes a side face 211 between the two ends thereof, as well as an engaging protrusion 212 protruding inwards from the side face 211. The engaging protrusion 212 includes an axial engaging face 212*a* on a side thereof facing the first frame 1*a*. Each second engaging member 22 is in the form of an engaging groove located at a position on an outer face of the frame body 11 of the second frame 1*b* aligned with a corresponding first engaging member 21, and includes an engaging portion 221. In this arrangement, as shown in FIGS. 5 and 6, the axial engaging face 212*a* of the engaging protrusion 212 may engage with the engaging portion 221 when the at least one first engaging member 21 (engaging panel) is engaged into the at least one second engaging member 22 (engaging groove). In addition, the side face 211 may abut against an inner groove wall of a corresponding second engaging member 22 (engaging groove) to prevent the axial disengagement between the first frame 1*a* and the second frame 1*b*.

The anti-rotation assembly 3 is disposed between the two frames 1 and includes at least one position-fixing member 31 and at least one blocking member 32. The at least one position-fixing member 31 and at least one blocking member 32 are formed on portions of the frames 1 where the frames 1 are coupled with each other. The at least one position-fixing member 31 and at least one blocking member 32 may be formed on or assembled to the two frames 1, respectively. In addition, the at least one position-fixing member 31 and the at least one blocking member 32 are of structures which allow them to abut against each other, such as a groove and an angular protrusion, a dovetail groove and a dovetail protrusion, or similar combinations. Based on this, the anti-rotation assembly 3 may further prevent the relative radial rotation between the frames 1 when the frames 1 are connected in series.

Figure 7:
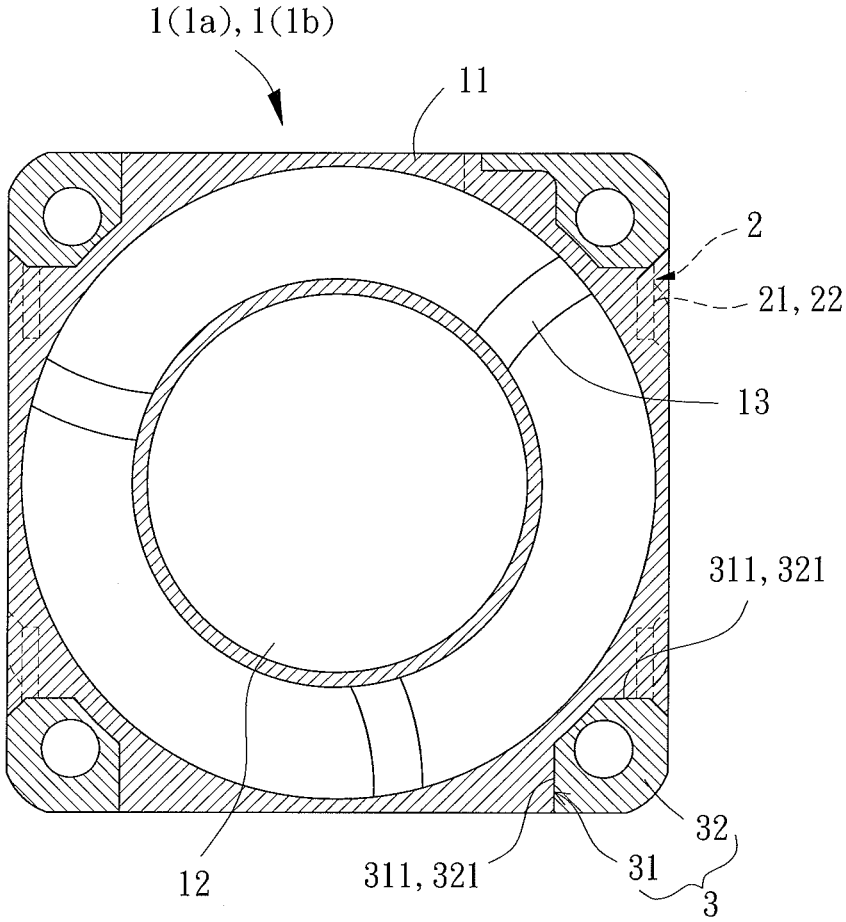
FIG. 7 shows a side cross-sectional view of the series-connected fan frame module observed at line 7-7 in FIG. 6, according to the preferred embodiment of the invention.

In the embodiment, the at least one position-fixing member 31 is located on the first frame 1*a* and the at least one blocking member 32 is located on the second frame 1*b*. Specifically, each position-fixing member 31 is in the form of a groove located on an outer face of the first frame 1*a*, with the position-fixing member 31 (groove) having a plurality of groove walls 311 extending in a direction from the air outlet 112 towards the air inlet 111 of the first frame 1*a*. Besides, each blocking member 32 is in the form of an angular protrusion located on a respective corner position of the second frame 1*b* aligned with a corresponding position-fixing member 31 (groove). In addition, each blocking member 32 (angular protrusion) has one end coupling with the second frame 1*b*, as well as the other end extending axially towards the first frame 1*a*. Moreover, each blocking member 32 (angular protrusion) has a plurality of abutting faces 321 between the two ends thereof, with each abutting face 321 facing the abutting face 321 of another blocking member 32 as shown in FIG. 4. Based on this, as shown in FIGS. 5 and 7, the abutting faces 321 of one blocking member 32 (angular protrusion) may abut against the groove walls 311 of a corresponding position-fixing member 31 (groove) when the position-fixing member 31 (groove) is coupled with the blocking member 32 (angular protrusion). Thus, relative radial rotation between the first frame 1*a* and the second frame 1*b* is further prevented when the first frame 1*a* and the second frame 1*b* are coupled together.

Figure 8:
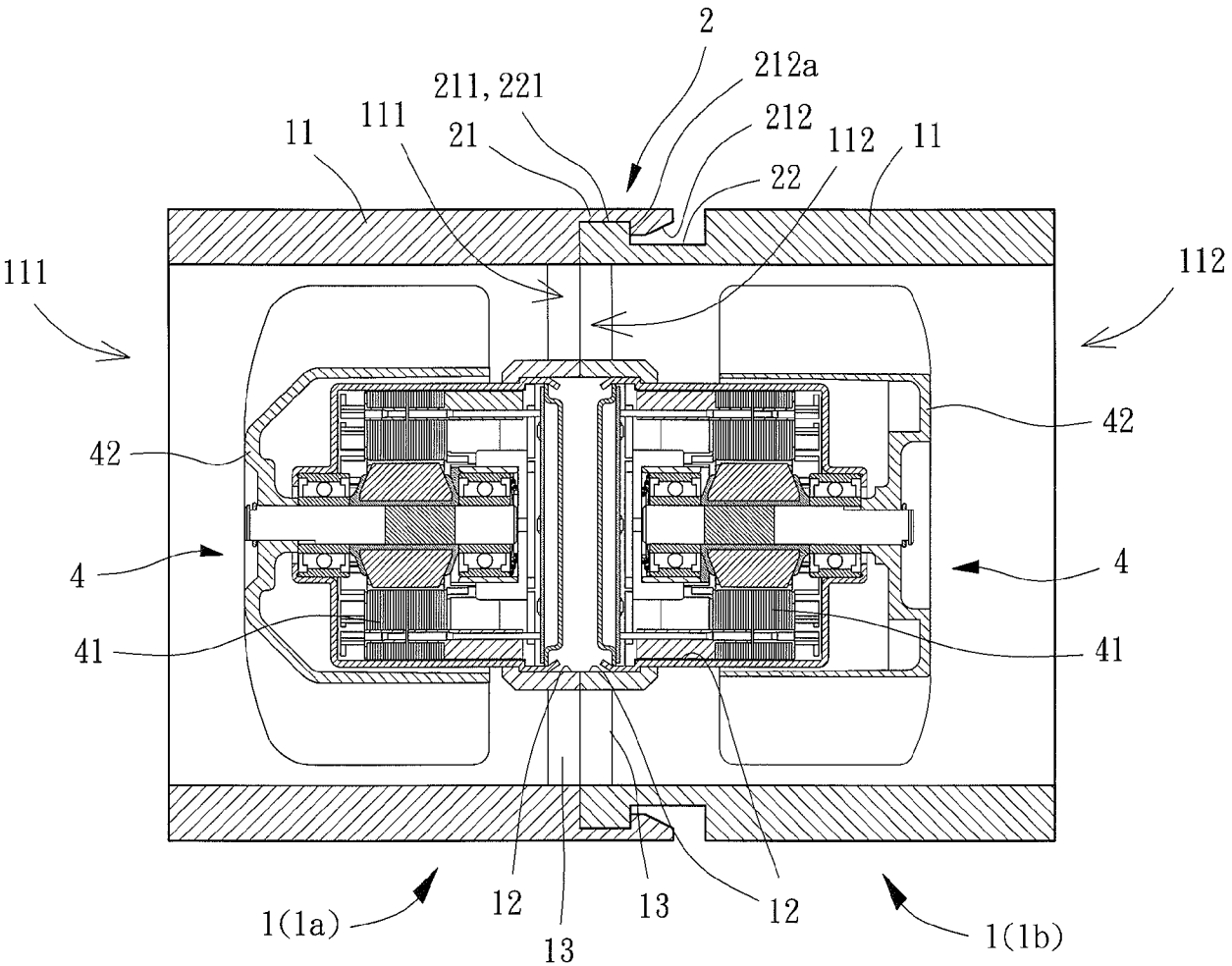
FIG. 8 shows a view of the series-connected fan frame module equipped with motors according to the preferred embodiment of the invention.

Referring to FIG. 8, when the series-connected fan frame module is in use, the frame body 11 of each frame 1 may receive a motor 4. The motor 4 includes a stator 41 and a rotor 42 coupled with the stator 41. The stator 41 is coupled with the base 12. Based on this, the stator 41 may drive the rotor 42 to rotate. The rotor 42 may be an impeller which generates air flow for cooling purposes. In addition, the frames 1 may be further coupled together in series to provide stronger air flow for an improved cooling effect.

The series-connected fan frame module of the invention is characterized in that, based on the engaging assembly 2 arranged between the frames 1, the at least one first engaging member 21 and the at least one second engaging member 22 may prevent both the axial disengagement and relative radial rotation between the frames 1 when the frames 1 are coupled together via the at least one first engaging member 21 and the at least one second engaging member 22. More importantly, apart from the engaging assembly 2, the invention additionally uses the anti-rotation assembly 3 to further prevent relative radial rotation between the frames 1. In this way, the load of the engaging assembly 2 may be effectively reduced, thereby avoiding the breaking or damage of the engaging assembly 2. Thus, the overall structural intensity of the series connected fan frame module is improved for a longer service life.

Furthermore, to complete the assembly of the series-connected fan frame module, a user is simply required to align the frames 1, engage the at least one first engaging member 21 with the at least one second engaging member 22, and align and engage the at least one position-fixing member 31 with the at least one blocking member 32. Generally speaking, quick assembly of the series-connected fan frame module can be achieved.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A series-connected fan frame module comprising:

first and second frames each having a first side and a second side spaced along an axis from the first side, with the first and second frames arranged in series with the first side of the first frame facing the second side of the second frame;

an engaging assembly arranged on each of the first and second frames to couple the frames in series, with the engaging assembly including a first engaging member on the first side of the first frame and extending from the first side of the first frame past the second side of the second frame and including a second engaging member on the second side of the second frame, with the first engaging member of the first frame engaging the second engaging member of the second frame, wherein the first engaging member is in a form of at least one engaging panel located on the first frame, wherein the second engaging member is in a form of at least one engaging groove located on the second frame and aligned with the at least one engaging panel, wherein the at least one engaging panel has one end coupling with the first frame and another end extending towards the second frame, wherein the at least one engaging panel further includes a side face between two ends thereof, as well as an engaging protrusion protruding from the side face, wherein the engaging protrusion includes an axial engaging face, wherein the second engaging member includes an engaging portion engaged with the axial engaging face, with the engaging portion having an axially extending surface and a radially extending surface, with the side face of the engaging panel of the first engaging member abutting with the axially extending surface of the engaging portion, and with the axial engaging face of the engaging protrusion of the first engaging member abutting with the radially extending surface of the engaging portion; and an anti-rotation assembly arranged on each of the first and second frames and comprising a position-fixing member on the first side of the first frame and a blocking member on the second side of the second frame, with the blocking member of the second frame extending from the second side of the second frame past the first side of the first frame, and wherein the position-fixing member is engaged with the blocking member to prevent relative radial rotation between the first and second frames.

2. The series-connected fan frame module as claimed in claim 1, wherein each of the first and second frames includes a frame body having an air inlet, an air outlet and a base disposed therein.

3. The series-connected fan frame module as claimed in claim 2, wherein the position-fixing member is in a form of at least one groove, and wherein the blocking member is in a form of at least one angular protrusion abutting against the at least one groove.

4. The series-connected fan frame module as claimed in claim 3, wherein the at least one groove is located on an outer face of the first frame, each of the at least one groove has a plurality of groove walls, each of the at least one angular protrusion has one end coupling with the second frame and another end extending towards the first frame, each of the at least one angular protrusion has a plurality of abutting faces between two ends thereof, and the plurality of abutting faces abuts against the plurality of groove walls.

5. The series-connected fan frame module as claimed in claim 4, wherein the plurality of groove walls extends in a direction from the air outlet towards the air inlet of the first frame.

6. The series-connected fan frame module as claimed in claim 5, wherein the anti-rotation assembly includes another blocking member, with each blocking member having a plurality of abutting faces, and one of the plurality of abutting faces of one of the blocking members faces a respective one of the plurality of abutting faces of another one of the blocking members.

7. The series-connected fan frame module as claimed in claim 2, wherein the base of each of the first and second frames is disposed in the frame body via a plurality of connection members.

8. The series-connected fan frame module as claimed in claim 1, wherein the engaging assembly includes another first engaging member, with the first engaging members opposing to each other, and the engaging protrusions of the first engaging members face each other.

9. The series-connected fan frame module as claimed in claim 1, further comprising another three engaging assemblies resulting in four engaging assemblies and another three anti-rotation assemblies resulting in four anti-rotation assemblies, wherein the four engaging assemblies are arranged on each of the first and second frames to couple the first and second frames in series, wherein each of the four engaging assemblies includes the first engaging member on the first side of the first frame and extending from the first side of the first frame past the second side of the second frame and includes the second engaging member on the second side of the second frame, wherein the first engaging member of the first frame engages the second engaging member of the second frame, wherein the four anti-rotation assemblies are arranged on each of the first and second frames, wherein each of the four anti-rotation assemblies comprises the position-fixing member on the first side of the first frame and the blocking member on the second side of the second frame, wherein the blocking member of the second frame extends from the second side of the second frame past the first side of the first frame, wherein the position-fixing member is engaged with the blocking member, wherein each of the first and second frames has a first outer face, a second outer face, a third outer face parallel to the first outer face, and a fourth outer face parallel to the second outer face, with the first, second, third and fourth outer faces extending between the first and second sides, wherein the first engaging members of two of the four engaging assemblies are coupled with the first outer face of the first frame, wherein the first engaging members of another two of the four engaging assemblies are coupled with the third outer face of the first frame, wherein the second engaging members of two of the four engaging assemblies are arranged on the first outer face of the second frame, wherein the second engaging members of another two of the four engaging assemblies are arranged on the third outer face of the second frame, wherein the position-fixing member of a first one of the four anti-rotation assemblies is interconnected between the first and second outer faces of the first frame, wherein the position-fixing member of a second one of the four anti-rotation assemblies is interconnected between the second and third outer faces of the first frame, wherein the position-fixing member of a third one of the four anti-rotation assemblies is interconnected between the third and fourth outer faces of the first frame, wherein the position-fixing member of a fourth one of the four anti-rotation assemblies is interconnected between the fourth and first outer faces of the first frame, wherein the position-fixing members of the four anti-rotation assemblies extend from the first side of the first frame towards but spaced from the second side of the first frame, wherein the blocking member of a first one of the four anti-rotation assemblies protrudes from between the first and second outer faces of the second frame, wherein the blocking member of a second one of the four anti-rotation assemblies protrudes from between the second and third outer faces of the second frame, wherein the blocking member of a third one of the four anti-rotation assemblies protrudes from between the third and fourth outer faces of the second frame, wherein the blocking member of a fourth one of the four anti-rotation assemblies protrudes from between the fourth and first outer faces of the second frame.

10. The series-connected fan frame module as claimed in claim 9, wherein each first engaging member includes one of the at least one engaging panel and the engaging protrusion protruding inwards from the one of the at least one engaging panel; wherein each second engaging member includes one of the at least one engaging groove formed in one of the first and third outer faces and defining the engaging portion, with the axially extending surface and the radially extending surface spaced from the one of the first and third outer faces, with the one of the at least one engaging panel of the first engaging member being flush with the one of the first and third outer faces wherein each position-fixing member is a groove having a plurality of groove walls extending axially inwardly from the first side of the first frame; and wherein each blocking member is an angular protrusion having a plurality of abutting faces abutting with the plurality of groove walls, with the groove of each second engaging member extending from the angular protrusion of a corresponding blocking member.

* * * * *